US009394742B2

(12) United States Patent
Knutson et al.

(10) Patent No.: US 9,394,742 B2
(45) Date of Patent: Jul. 19, 2016

(54) FLEXIBLE INSULATED DOOR PANELS WITH INTERNAL BAFFLES

(75) Inventors: Perry W. Knutson, Lancaster, WI (US); Mark Ungs, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 1027 days.

(21) Appl. No.: 12/325,944

(22) Filed: Dec. 1, 2008

(65) Prior Publication Data

US 2010/0132894 A1 Jun. 3, 2010

(51) Int. Cl.

| | |
|---|---|
| ***F25D 23/02*** | (2006.01) |
| ***E06B 9/13*** | (2006.01) |
| *E06B 9/17* | (2006.01) |

(52) U.S. Cl.

CPC ..... *E06B 9/13* (2013.01); *E06B 2009/17069* (2013.01); *F25D 23/021* (2013.01)

(58) Field of Classification Search

USPC ..... 160/201, 232, 236, 230, 231.1, 231.2; 52/2.17, 2.22, 2.23, 2.24

See application file for complete search history.

(56) References Cited

U.S. PATENT DOCUMENTS

| | | | | |
|---|---|---|---|---|
| 1,421,906 A | | 7/1922 | Calef | |
| 2,113,068 A | | 4/1938 | McLaughlin, Jr. | |
| 2,342,839 A | | 2/1944 | Byers | |
| 3,017,218 A | * | 1/1962 | Carlsson et al. | 296/106 |
| 3,036,670 A | * | 5/1962 | Jewell | 52/578 |
| 3,055,379 A | * | 9/1962 | Fink | 52/2.18 |
| 3,186,896 A | | 6/1965 | Clem | |
| 3,231,006 A | * | 1/1966 | Fisher et al. | 160/41 |
| 3,544,417 A | | 12/1970 | Corzine | |
| 3,662,410 A | * | 5/1972 | Lankheet | 4/498 |
| 3,724,526 A | | 4/1973 | Huprich | |
| 3,856,072 A | | 12/1974 | Sund | |
| 3,975,882 A | | 8/1976 | Walter | |
| 4,039,019 A | | 8/1977 | Hopper | |
| 4,040,210 A | * | 8/1977 | Land | 52/2.12 |
| 4,070,839 A | | 1/1978 | Clem | |

(Continued)

FOREIGN PATENT DOCUMENTS

| | | |
|---|---|---|
| CN | 2692316 | 4/2005 |
| DE | 2722005 | 11/1977 |

(Continued)

OTHER PUBLICATIONS

International Searching Authority, "International Search Report" issued in connection with International application No. PCT/US2011/042947, mailed on Sep. 28, 2011, 3 pages.

(Continued)

*Primary Examiner* — David Purol

(74) *Attorney, Agent, or Firm* — Hanley, Flight and Zimmerman

(57) ABSTRACT

An example of a vertically operating door includes a flexible panel comprising two pliable sheets of material with a plurality of pads or mats of thermal insulation between the two sheets. In some examples, a plurality of horizontally elongate baffles made of pliable strips of material are installed between the two sheets. The baffles effectively divide one large interior volume between the sheets into more manageable smaller volumes or chambers. The baffles restrict the air between the sheets from being forced to the bottom of the panel as the panel ascends and bends across an overhead roller. Without the baffles and smaller chambers, the panel sheets in the area near the bottom of the panel would tend to bulge outward as the door opens.

27 Claims, 8 Drawing Sheets

(56) References Cited

U.S. PATENT DOCUMENTS

| | | | | |
|---|---|---|---|---|
| 4,115,610 | A | 9/1978 | Wortman | |
| 4,255,907 | A * | 3/1981 | Lightell | 52/2.12 |
| 4,294,875 | A | 10/1981 | Schramm | |
| 4,506,720 | A | 3/1985 | Iwanicki | |
| 5,016,700 | A * | 5/1991 | Wegner et al. | 160/232 |
| 5,249,323 | A | 10/1993 | Kikuchi et al. | |
| 5,544,690 | A | 8/1996 | Magro et al. | |
| 5,586,594 | A * | 12/1996 | Shapoff | 160/135 |
| 5,664,613 | A | 9/1997 | Jelic | |
| 5,738,161 | A * | 4/1998 | Martin | 160/201 |
| 5,813,172 | A | 9/1998 | McNally | |
| 5,855,235 | A | 1/1999 | Colson et al. | |
| 5,915,445 | A * | 6/1999 | Rauenbusch | 160/230 |
| 6,001,199 | A | 12/1999 | Colson et al. | |
| 6,112,797 | A | 9/2000 | Colson et al. | |
| 6,119,758 | A * | 9/2000 | Coenraets | 160/273.1 |
| 6,199,337 | B1 | 3/2001 | Colson et al. | |
| 6,354,353 | B1 | 3/2002 | Green et al. | |
| 6,659,158 | B2 | 12/2003 | Laugenbach | |
| 6,688,369 | B2 | 2/2004 | Colson et al. | |
| 6,725,898 | B2 * | 4/2004 | Mullet et al. | 160/232 |
| 7,059,378 | B2 | 6/2006 | Colson et al. | |
| 7,748,169 | B2 | 7/2010 | Cote | |
| 7,992,678 | B2 | 8/2011 | Pilaar | |
| 8,043,690 | B2 | 10/2011 | Hand et al. | |
| 2001/0005964 | A1 | 7/2001 | Colson et al. | |
| 2003/0041981 | A1 | 3/2003 | Cramer, III | |
| 2007/0277943 | A1 * | 12/2007 | Boerger et al. | 160/273.1 |
| 2008/0110580 | A1 * | 5/2008 | Hoerner et al. | 160/113 |
| 2009/0139665 | A1 | 6/2009 | Cha | |
| 2010/0132894 | A1 | 6/2010 | Knutson et al. | |
| 2011/0289857 | A1 | 12/2011 | Pilaar | |
| 2012/0018102 | A1 | 1/2012 | Ungs et al. | |
| 2012/0085504 | A1 | 4/2012 | Cha | |
| 2013/0098567 | A1 | 4/2013 | Ashelin et al. | |

FOREIGN PATENT DOCUMENTS

| | | |
|---|---|---|
| EP | 0123508 | 10/1984 |
| EP | 0358920 | 3/1990 |
| JP | 3093791 | 5/2003 |
| NL | 7805464 | 10/1979 |
| RU | 1778263 | 11/1992 |
| RU | 2571814 | 12/2015 |
| WO | 9112404 | 8/1991 |

OTHER PUBLICATIONS

International Searching Authority, "Written Opinion of the International Searching Authority" issued in connection with application No. PCT/US2011/042947, mailed on Sep. 28, 2011, 5 pages.

IP Australia, "Examination Report," issued in connection with corresponding Australian Patent Application No. 2009355386, issued on Oct. 16, 2012 (3 pages).

New Zealand Patent Office, "First Examination Report," issued in connection with New Zealand Patent Application No. 593206, mailed on Aug. 16, 2012, 4 pages.

International Searching Authority, International Preliminary Report on Patentability, issued in connection with International Patent Application Serial No. PCT/US09/65554, mailed on Apr. 19, 2012, 8 pages.

United States Patent and Trademark Office Non-Final Office Action, issued in connection with U.S. Appl. No. 12/843,538, mailed on Aug. 2, 2012, (28 pages).

First Official Action issued by the Canadian Intellectual Property Office on May 22, 2012, in connection with Canadian Patent Application No. 2,745,244 (3 pages).

PCT, International Preliminary Report on Patentability, issued in connection with International Patent Application No. PCT/US2011/042947, dated Feb. 7, 2013 (6 pages).

USPTO, Office Action, issued in connection with U.S. Appl. No. 12/843,538, dated Feb. 27, 2013 (14 pages).

Australian Intellectual Property Office, "Certificate of Grant", issued in connection with Australia patent No. 2009355386, issued on Jan. 30, 2014, 1 page.

Mexican Patent Office, Office Action, issued in connection with Mexican Application No. MX/a/2011/005757, dated Oct. 4, 2013, and corresponding English translation, 7 pages.

New Zealand Intellectual Property Office, First Examination Report, issued in connection with New Zealand Application No. 605738, dated Aug. 19, 2013, 2 pages.

European Patent Office, Examination Report, issued in connection with European Application No. 11731231.4, dated Nov. 8, 2013, 5 pages.

European Patent Office, Communication pursuant to Rules 161(1) and 162 EPC, issued in connection with European Application No. 09851353.4, dated May 25, 2012, 2 pages.

State Intellectual Property Office of China, First Office Action, issued in connection with corresponding Chinese Patent Application No. 200980150894.X, issued Dec. 23, 2013, and corresponding English translation, 11 pages.

Canadian Intellectual Property Office, Notice of Allowance, issued in connection with Canadian Application No. 2,745,244, dated Jan. 2, 2014, 1 page.

Canadian Intellectual Property Office, Office Action, issued in connection with Canadian Application No. 2,806,022, dated Jan. 6, 2014, 2 pages.

Intellectual Property Office of New Zealand, Notice of Acceptance, issued in connection with New Zealand Patent Application No. 593,206, dated Nov. 13, 2013, 1 page.

Intellectual Property Office of Australia, Notice of Acceptance, issued in connection with corresponding Australian Patent Application No. 2009355386, dated Oct. 4, 2013, 2 pages.

Japanese Patent Office, Notice of Reasons for Rejection issued in connection with corresponding Japanese Patent Application No. P2013-521792 on Mar. 4, 2014 (4 pages).

United States Patent and Trademark Office, Office Action, issued in connection with U.S. Appl. No. 12/843,538, dated Feb. 27, 2013 (14 pages).

Mexican Intellectual Property Office, Office action, issued in connection with Patent application No. MX/a/2011/005757, issued on Feb. 13, 2014, 5 pages.

New Zealand Intellectual Property Office, Letters Patent, issued in connection with New Zealand patent No. 593206, dated on Mar. 4, 2014, 1 page.

Australian Intellectual Property Office, Patent Examination Report No. 1, issued in connection with Australia patent No. 2011283144, issued on Apr. 14, 2014, 4 pages.

State Intellectual Property Office of the People'S Republic of China, Second Office Action, issued in connection with Chinese patent application No. 200980150894.X, mailed on May 20, 2014, 13 pages.

Russian Intellectual Property Office, Office action, issued in connection with Russian patent application No. 2013103440, mailed on May 28, 2014, 8 pages.

State Intellectual Property Office of the People's Republic of China, First Office action, issued in connection with Chinese patent application No. 201180036502.4, mailed on Jun. 11, 2014, 7 pages.

Canadian Intellectual Property Office, Letters of Patent, issued in connection with Canadian patent application No. 2,745,244, issued on Jul. 15, 2014, 1 page.

Japanese Patent Office, Notice of Allowance, issue in connection with Japanese Patent application No. 2013-521792, on Sep. 24, 2014. (English Translation not provided) 4 pages.

Mexican Patent Office, Office action, issued in connection with mexican patent application No. MX/a/2011/005757, mailed on Sep. 8, 2014, 5 pages.

Russian Patent Office, Substantive Examination, issued in connection with Russian patent application No. 2013103440, issued on Nov. 21, 2014, 9 pages.

New Zealand Intellectual Property Office, Notice of Acceptance, issued in connection with New Zealand patent application No. 605738, issued on Jan. 28, 2015, 1 page.

(56) References Cited

OTHER PUBLICATIONS

European Patent Office, Communication under Rule 71(3) EPC, issued in connection with European patent application No. 11 731 231.4, mailed on Feb. 11, 2015, 35 pages.
Mexican Patent Office, Office action, issued in connection with Mexican patent application No. MX/a/2013/000678, mailed on May 28, 2015, 3 Pages.
Australian Intellectual Property Office, Notice of Acceptance, issued in connection with Australian patent application No. 2011283144, Jun. 3, 2014, 1 page.
European Patent Office, "Decision to grant a European patent pursuant to Article 97(1)EPC", issued in connection with European patent application No. 11731231.4, Jul. 23, 2015, 2 pages.
Intellectual Property Office of New Zealand, Letters Patent, issued in connection with New Zealand patent No. 605738, issued on May 1, 2015, 1 page.
United States Patent and Trademark Office, Final Office action, issued in connection with U.S. Appl. No. 12/843,538, mailed on Oct. 15, 2013, 7 pages.
United States Patent and Trademark Office, Advisory Action, issued in connection with U.S. Appl. No. 12/843,538, mailed on Dec. 30, 2013, 4 pages.
United States Patent and Trademark Office, Non-Final Office action, issued in connection with U.S. Appl. No. 12/843,538, mailed on Mar. 28, 2014, 8 pages.
United States Patent and Trademark Office, Final Office action, issued in connection with U.S. Appl. No. 12/843,538, mailed on Sep. 4, 2014, 7 pages.
United States Patent and Trademark Office, Non-Final Office action, issued in connection with U.S. Appl. No. 12/843,538, mailed on Dec. 23, 2014, 6 pages.
United States Patent and Trademark Office, Final Office action, issued in connection with U.S. Appl. No. 12/843,538, mailed on May 14, 2015, 8 pages.
Mexican Patent Office, Notice of Allowance, issued in connection with Mexican patent application No. MX/a/2013/000678, Sep. 28, 2015, 2 pages.
Chinese Intellectual Property Office, Notice of Completing Formalities for Patent Registration, issued in connection with Chinese patent application No. 200980150894.X, Sep. 23, 2015, 4 pages.
Australian Patent Office, Certificate of Grant, issued in connection with Australian patent No. 2011283144, Oct. 1, 2015, 1 page.
Russian Patent Office, Notice of Grant, issued in connection with Russian patent application No. 2013103440, dated Jul. 20, 2015, 16 pages.
United States Patent and Trademark Office, Examiner's Answer, issued in connection with U.S. Appl. No. 12/843,538, mailed on Feb. 11, 2016, 9 pages.
International Searching Authority, Search Report, issued in connection with International Patent Application Serial No. PCT/US09/65554, mailed on Mar. 29, 2012, 5 pages.
International Searching Authority, Written Opinion, issued in connection with International Patent Application Serial No. PCT/US09/65554, mailed on Mar. 29, 2012, 7 pages.
International Searching Authority, International Preliminary Report on Patentability, issued in connection with International Patent Application Serial No. PCT/US09/65554, mailed on Apr. 19, 2012, 9 pages.
United States Patent and Trademark Office, Non-Final Office Action, issued in connection with U.S. Appl. No. 12/843,538, mailed on Aug. 2, 2012, (28 pages).
Canadian Patent Office, First Official Action issued in connection with Canadian Patent Application No. 2,745,244 on May 22, 2012, (3 pages).
Canadian Patent Office, Office Action, issued in connection with Canadian Patent Application No. 2,745,244, dated Mar. 14, 2013 (2 pages).
Canadian Intellectual Property Office, Notice of Allowance, issued in connection with canadian patent application No. 2,806,022, issued on Nov. 27, 2014, 1 page.
Japanese Patent Office, Certificate of Patent, issued in connection with Japanese patent application No. 2013-521792, issued on Oct. 31, 2014, 2 pages.
Chinese Patent Office, Notice of Completing formalities for Patent Registration, issued in connection with Chinese patent application No. 201180036502.4, issued on Mar. 5, 2015, 8 pages.
European Patent Office, Intend to Grant, issued in connection with European patent application No. 11 731 231.4-1604, dated Feb. 11, 2015, 35 pages.
Chinese Patent Office, The Third Office action, issued in connection with Chinese patent application No. 200980150894.X, dated Apr. 10, 2015, 4 pages.
Chinese Patent Office, Decision to revoke decision, issued in connection with Chinese patent office action No. 200980150894.X, dated on Apr. 2, 2015, 2 pages. ( English translation not provided).
Mexican Patent Office, Office Action, issued in connection with Mexican patent office action No. MX/a/2011/005757, dated on Mar. 19, 2015, 6 pages.
International Searching Authority, International Preliminary Report on Patentability, issued in connection with International Patent Application No. PCT/US2011/042947, dated Feb. 7, 2013 (6 pages).
European Patent Office, Communication pursuant to Article 94(3) EPC, issued in connection with European patent application No. 09 851 353.4, mailed on May 6, 2016, 6 pages.

* cited by examiner

FLEXIBLE INSULATED DOOR PANELS WITH INTERNAL BAFFLES

FIELD OF THE DISCLOSURE

This patent generally relates to insulated doors and, more specifically, to doors that include a flexible panel such as an insulated curtain.

BACKGROUND

Cold storage rooms are refrigerated areas in a building that are commonly used for storing perishable foods. Cold storage rooms are typically large enough for forklifts and other material handling equipment to enter. Access to the room is often through a power actuated insulated door that separates the room from the rest of the building. To minimize thermal losses when someone enters or leaves the room, the door preferably opens and closes as quickly as possible.

Vertically operating roll-up doors and similar doors with flexible curtains are perhaps some of the fastest operating doors available. When such a door opens, its curtain usually bends upon traveling from its closed position in front of the doorway to its open position on an overhead storage track or take-up roller.

Such bending is not a problem if the curtain is relatively thin. However, an insulated curtain may not bend as well due to the required thickness of the insulation. When a take-up roller or curved track bends a thick curtain, relative translation may occur between opposite faces of the curtain. Designing a thick, insulated curtain that can accommodate such translation can be challenging.

Moreover, if an insulated curtain becomes temporarily creased or locally compressed along the horizontal line where the curtain bends, such a crease or compression might trap a pocket of air inside the curtain, and that trapped air might cause the curtain to bulge and adversely affect the door's operation.

DETAILED DESCRIPTION

Figure 1:
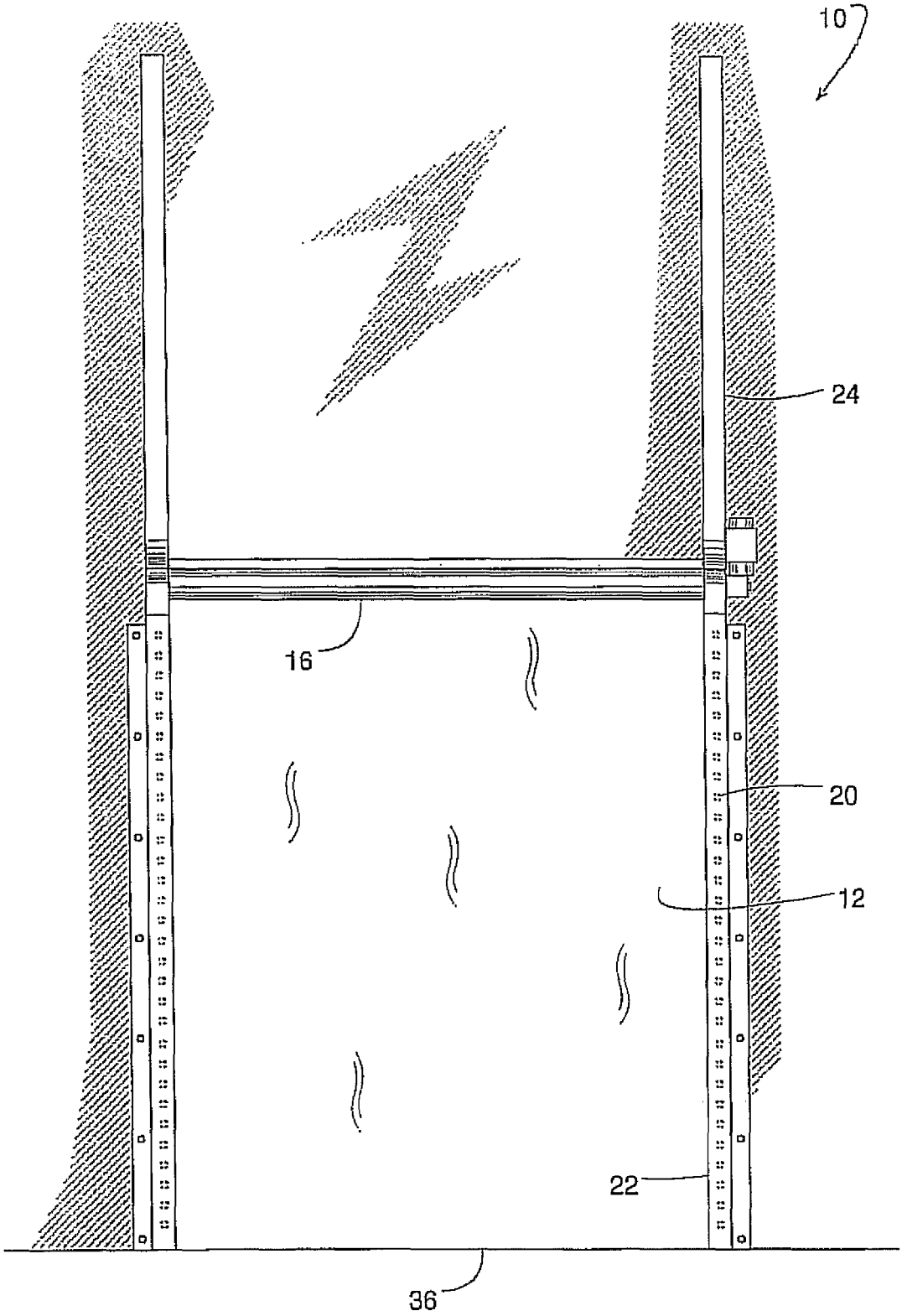
FIG. 1 is a front view showing an example door in a closed position.
Figure 2:
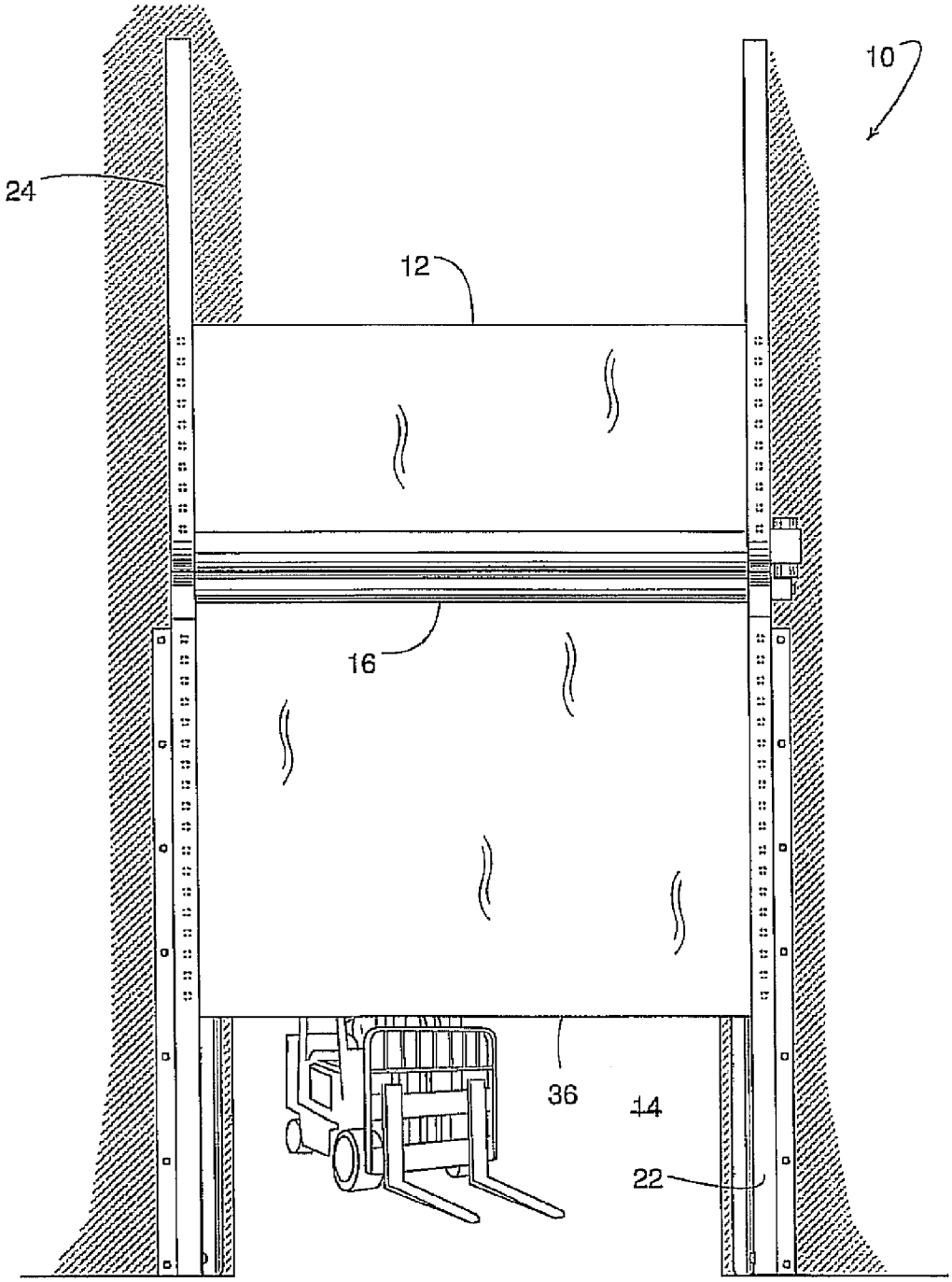
FIG. 2 is a front view similar to FIG. 1 but showing the example door partially open.
Figure 3:
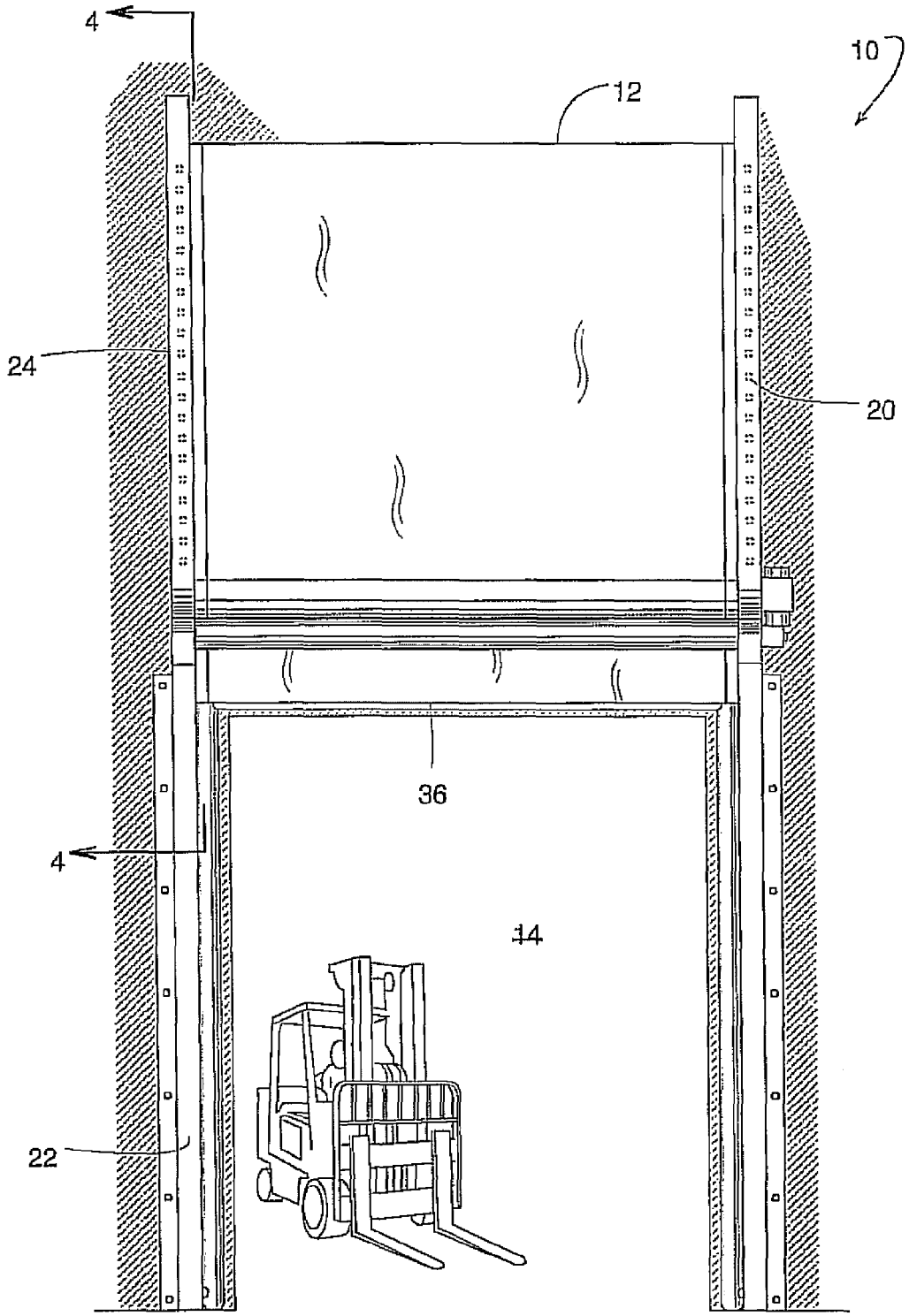
FIG. 3 is a front view similar to FIGS. 1 and 2 but showing the example door in an open position.
Figure 4:
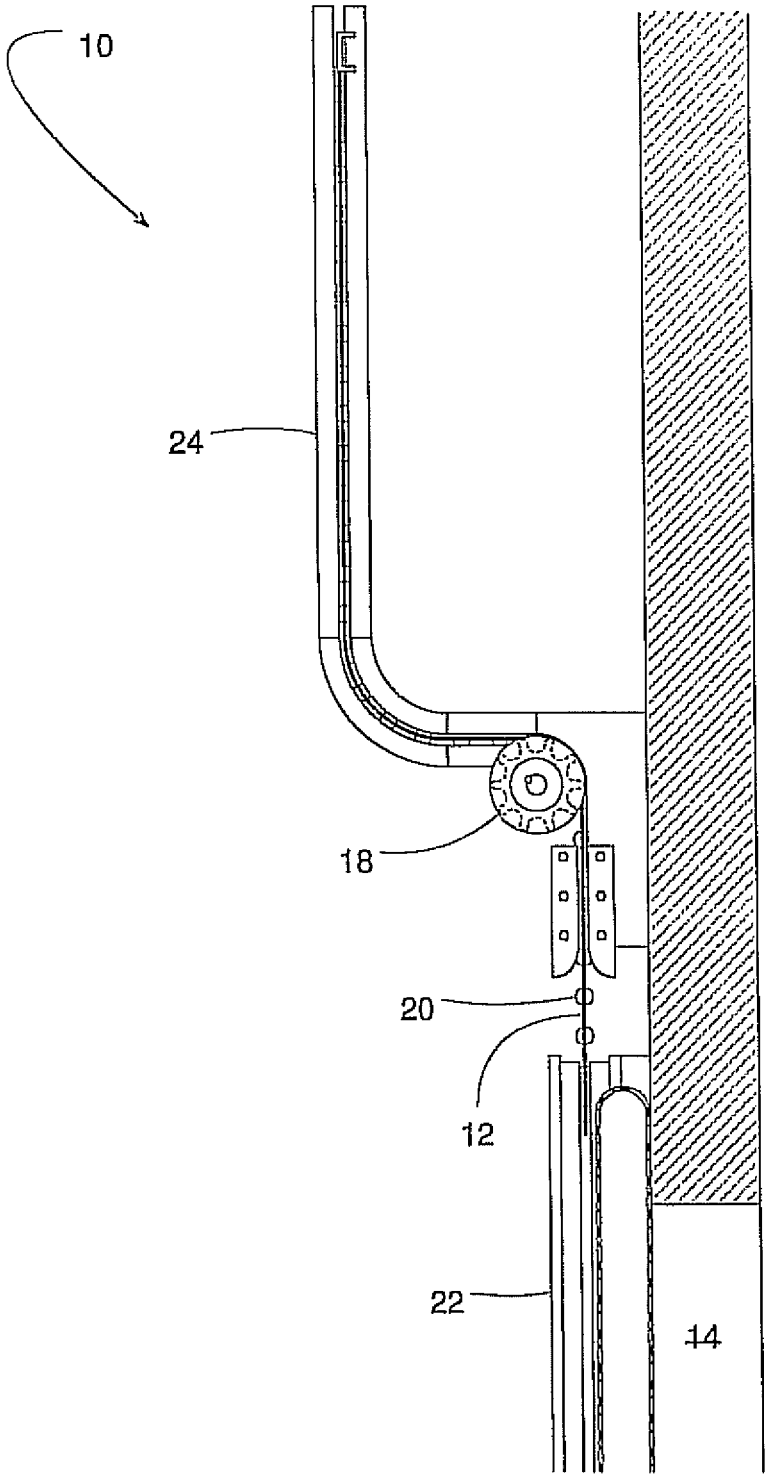
FIG. 4 is a cross-sectional view taken along line 4-4 of FIG. 3.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

FIGS. 1-4 illustrate a vertically operating door 10 that includes a flexible, insulated door panel 12 with means for managing undesirable air pressure conditions inside the panel. Door 10 is shown closed in FIG. 1, partially open in FIG. 2, and fully open in FIGS. 3 and 4. As door 10 opens and closes relative to a doorway 14, door panel 12 bends over a mandrel 16, which contributes to the air pressure problem that is addressed by the example methods and apparatus described herein. Mandrel 16 can be a fixed bar or a roller that extends across the width of doorway 14. Although door panel 12 is shown having a certain double-bend, stored configuration, other stored configurations, such as coiled, wound on a roll tube, single-bend horizontal, serpentine, vertically planar, etc., are all well within the scope of this disclosure. Door 10 is particularly suited for a cold storage room. However, door 10 could also be applied to any other desired application.

With the exception of door panel 12 itself, the structure, operation and other details of door 10 are described and illustrated in U.S. Patent Application Publication No. US 2008/0110580 A1, which is hereby incorporated herein by reference in its entirety. Generally, a powered drive sprocket 18 (FIG. 4) engages a cogged strip 20 at each lateral edge of door panel 12 to move door panel 12 between a lower guide track 22, where door panel 12 is blocking doorway 14, and an upper track 24 where door panel 12 is clear of the doorway. It should be noted, however, that door panel 12 can be applied to various other types of doors that operate with different drive or storage configurations. In each case, the thickness of the door panel, combined with air trapped therein and a bending of the panel, can cause the trapped air to balloon the bottom of the curtain or panel as the door opens.

Publication No. US 2008/0110580 A1 also explains the benefit of equipping an insulated door panel with an evacuation blower. However, unlike that published application, the example apparatus described herein enables the door panel 12 to be advantageously utilized without such a blower and associated hardware.

Figure 5:
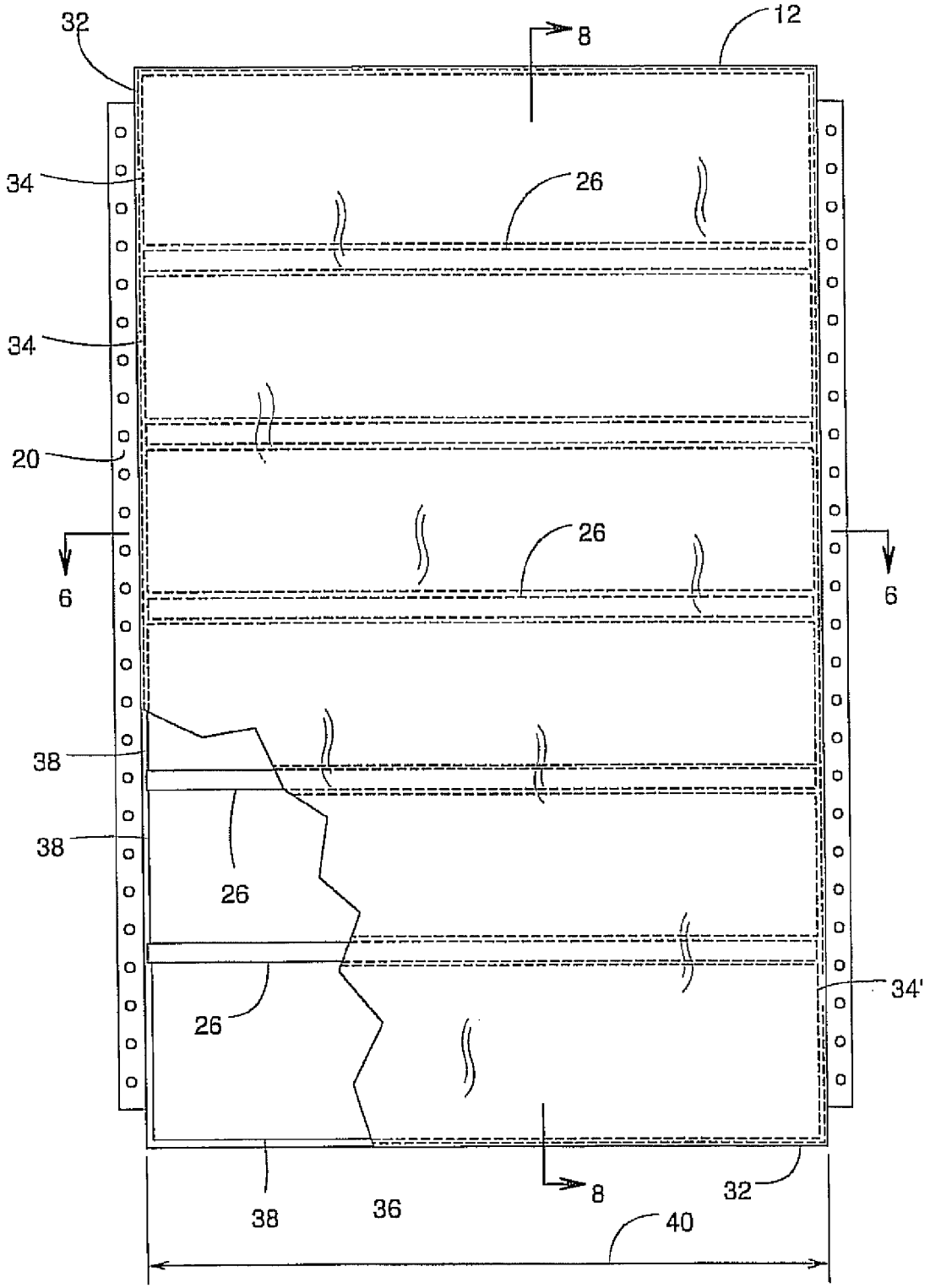
FIG. 5 is a front view of the example door panel of FIGS. 1-3 with a lower-left section of the panel's outer sheet cutaway.
Figure 6:
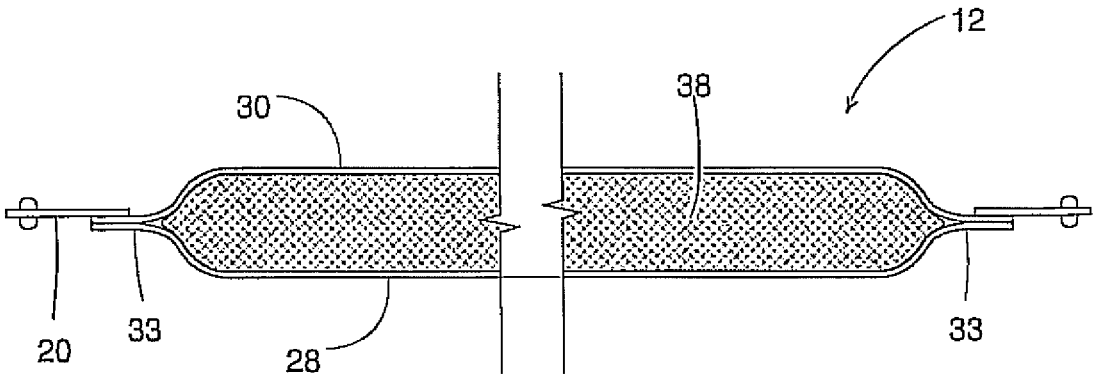
FIG. 6 is a cross-sectional view taken along line 6-6 of FIG. 5.
Figure 7:
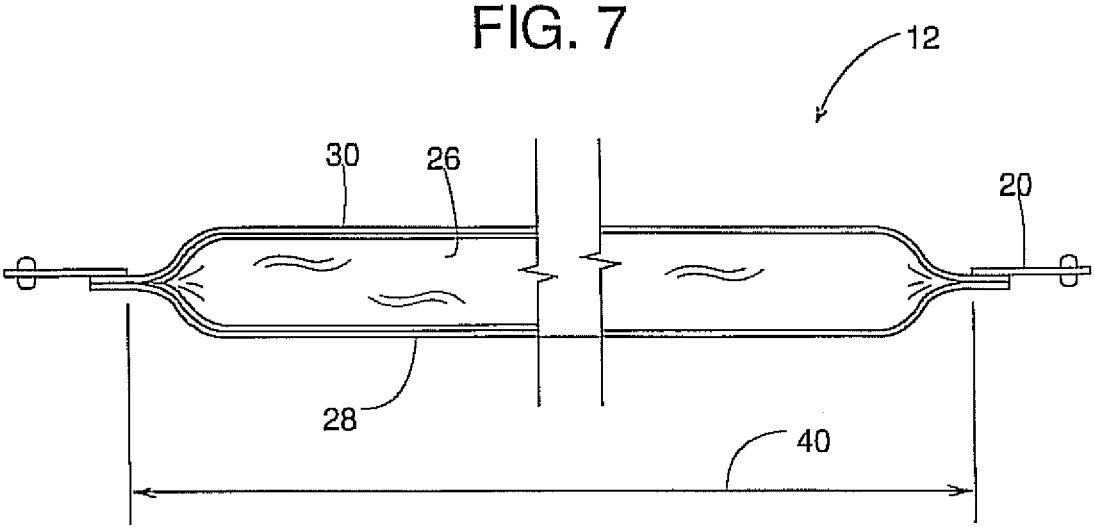
FIG. 7 is a cross-sectional view similar to FIG. 6 but with the insulation omitted to more clearly show one of the example baffles.
Figure 8:
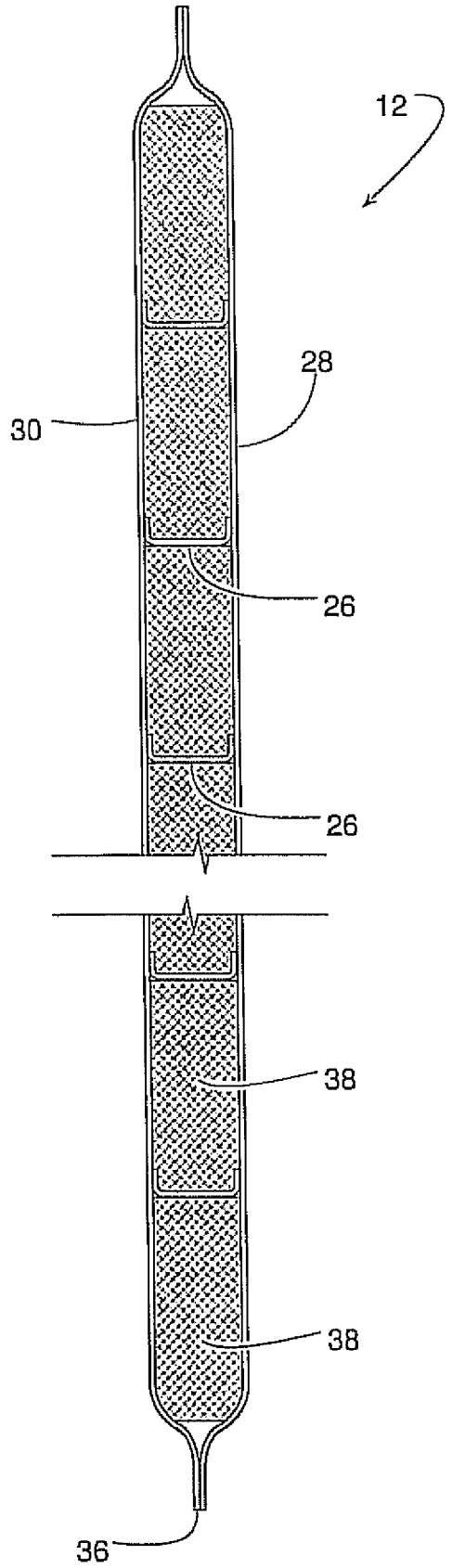
FIG. 8 is a cross-sectional view taken along line 8-8 of FIG. 5.

Instead of using an evacuation blower, door panel 12 includes a plurality of pliable baffles 26 (FIGS. 5-9) that restrict the redistribution of air contained between a first sheet 28 and a second sheet 30 of door panel 12. Sheets 28 and 30 are joined and generally sealed along their outer perimeter to create one large overall air chamber 32 between sheets 28 and 30. Baffles 26 divide chamber 32 into a plurality of more manageable smaller chambers 34. For illustrative clarity, baffles 26 and chambers 32 and 34 are shown in FIG. 5 to extend slightly less than a full width 40 of door panel 12, however, baffles 26 and chambers 32 and 34 preferably extend the full width of door panel 12 as depicted in FIG. 5. As door 10 opens and creates a horizontal crease in sheets 28 and 30 (e.g., where door panel 12 bends over mandrel 16), baffles 26 help prevent air trapped within chamber 32 from over inflating the lower end of door panel 12. Thus, baffles 26 prevent the area between mandrel 16 and a lower leading edge 36 of door panel 12 from bulging excessively as door 10 opens.

While the division of large chamber 32 into smaller, more manageable chambers 34 helps solve the problems caused by air trapped in door panel 12, baffles 26 used for this purpose may have other desirable properties. For example, baffles 26 may be sufficiently flexible to accommodate some relative translation between sheets 28 and 30 as door panel 12 bends over mandrel 16. The flexibility of baffles 26 may also enable door panel 12 to restorably break away if something were to accidentally collide with the door. Additionally or alternatively, baffles 26 may be sufficiently flexible to conformingly mate with the lateral edges or vertical seams 33 of sheets 28 and 30 so that there is minimal leakage or air exchange between chambers 34. Further, in some examples, baffles 26 preferably are sufficiently stiff to maintain a desired spacing between sheets 28 and 30, particularly in examples where insulation is not used for maintaining such spacing. Further yet, in some examples, baffles 26 preferably have a thermal conductivity that generally is less than or equal to that of sheets 28 and 30. The R-value of air enhanced with insulation in chambers 34 may be sufficient for preventing frost from forming on door panel 12. However, if baffles 26 have relatively high thermal conductivity, frost lines might form on sheet 28 or 30 where baffles 26 connect to those sheets.

Although the actual construction of door panel 12 may vary, the illustrated examples have sheets 28 and 30 being made of any suitable polymeric or natural fabric material that is preferably pliable and can be joined along their outer perimeter by adhesion, tape, melting/fusing/welding, sewing, hook-and-loop fastener, snaps, rivets, zipper, etc. Substantially the entire outer perimeter, including seams 33 and the upper and lower edges of door panel 12, is preferably sealed to prevent appreciable amounts of air from flowing in and out of chamber 32. Inhibiting moist air from repeatedly entering chamber 32 prevents mold-promoting moisture from condensing inside chamber 32 on a panel sheet that is facing, for example, a cold storage room.

Baffles 26 can be made of a material similar to or different than that of sheets 28 and 30. The flexibility of sheets 28 and 30 enables door panel 12 to bend over mandrel 16, while the flexibility of baffles 26 enables limited relative translation between sheets 28 and 30 as door 10 opens and closes. As door 10 opens or closes and door panel 12 travels and bends across mandrel 16, this action urges relative vertical translation between sheets 28 and 30. Thermal insulation 38, such as porous foam pads or polyester mats, preferably is installed within chambers 34.

For the illustrated examples, baffles 26 are horizontally elongate, which enable them to not only restrict vertical airflow within door panel 12 but also to accommodate relative vertical translation between sheets 28 and 30. In other examples, door panel 12 is provided with vertically elongate baffles or a combination of vertical and horizontal baffles.

To effectively restrict airflow within door panel 12, horizontally elongate baffles 26 preferably extend along at least most of the full width 40 of door panel 12. To facilitate manufacturing, however, baffles 26 can be made slightly shorter than the panel's full width 40 to make it easier to join the lateral vertical edges of sheets 28 and 30 together. Baffles 26 being a little shorter than full width 40 of door panel 12 places the plurality of air chambers 34 in fluid communication with each other. Thus, as door 10 opens and door panel 12 travels across mandrel 16, some air within door panel 12 will be temporarily redistributed to at least one of the lower chambers (e.g., air chamber 34') of the plurality of chambers 34, thereby slightly increasing the air pressure within chamber 34' temporarily, but not really detrimentally.

Figure 9:
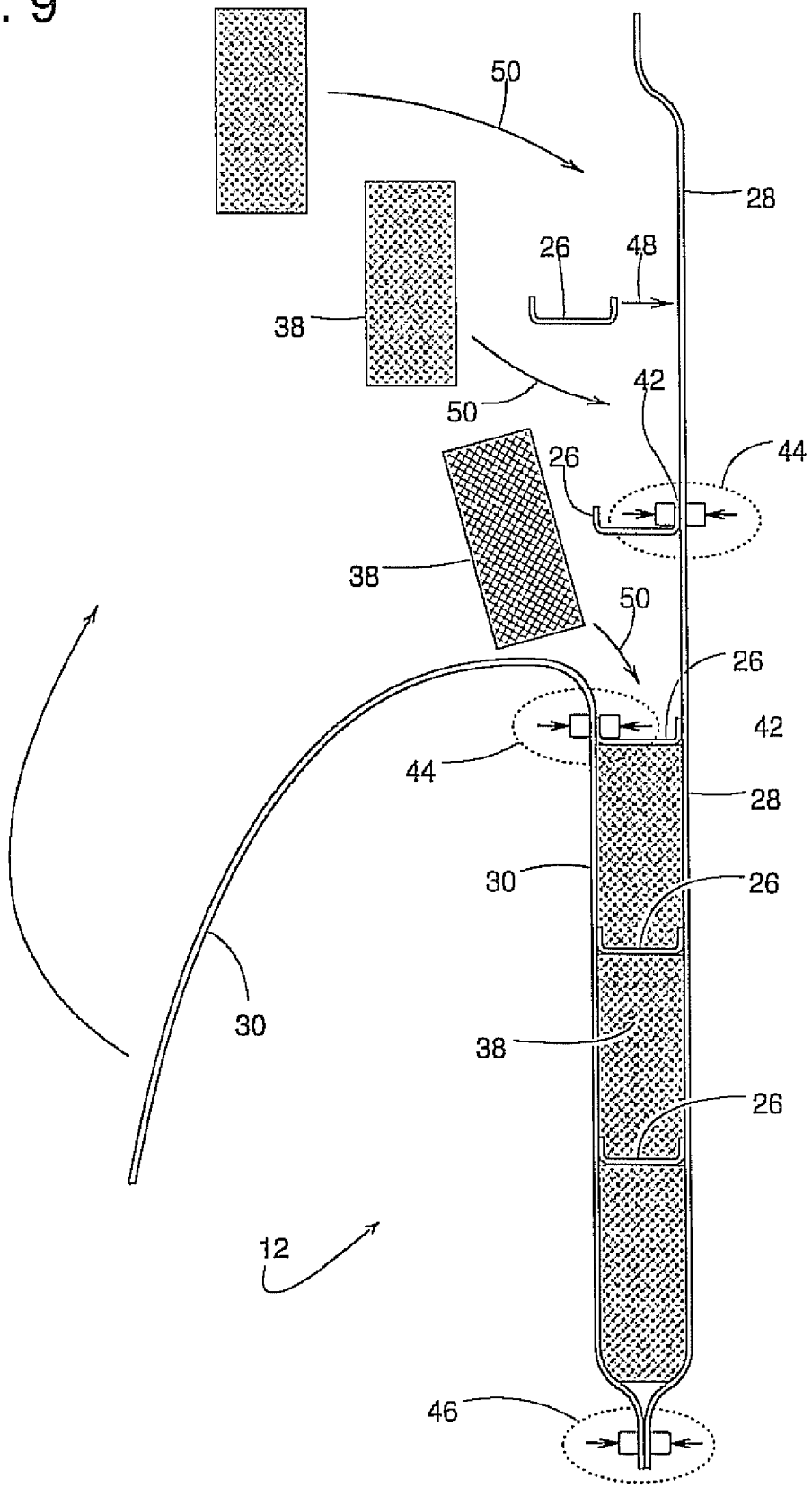
FIG. 9 is a cross-sectional view similar to FIG. 8 but showing the example door panel being assembled.

Although door panel 12 could be manufactured by several different methods, FIG. 9 illustrates one example manufacturing method. One horizontal edge of each baffle 26 is melted or ultrasonically welded to first sheet 28, thereby creating a plurality of fused joints 42 between sheet 28 and each of baffles 26. Fusing baffles 26 to at least one of sheets 28 and 30 is schematically depicted by the block at reference number 44 of FIG. 9. Alternate methods of attaching baffles 26 in place include, but are not limited to, bonding, taping, sewing, fastening via hook-and-loop fastener, riveting, etc.

An outer perimeter of sheet 28 is fused, sewn or otherwise connected to sheet 30 as schematically depicted by the block at reference number 46 of FIG. 9. The plurality of baffles 26 are installed between sheets 28 and 30, as schematically depicted by arrow 48 and insulation 38 is installed within chambers 34, as schematically depicted by arrows 50. The example method represented by the block at reference number 44 and arrows 48 and 50 may be done generally together in a progressive sequence from one end of door panel 12 to another or in any other suitable order. FIG. 9, for example, shows door panel 12 being assembled progressively from the bottom up.

At least some of the aforementioned examples include one or more features and/or benefits including, but not limited to, the following:

In some examples, a door panel is comprised of two pliable sheets with a plurality of pliable baffles therebetween, wherein the baffles are horizontally elongate to not only restrict airflow within the panel but also to accommodate relative vertical translation between the two sheets.

In some examples, the baffles are sufficiently flexible or pliable to enable the two sheets to pinch together as the panel bends over a mandrel.

In some examples, a door panel is comprised of two pliable, generally parallel sheets to create an overall air chamber. The panel also includes a plurality of baffles that divide the overall air chamber into a plurality of smaller, more manageable chambers.

In some examples, the smaller, more manageable chambers are in fluid communication with each other.

In some examples, the horizontal baffles do not extend the full width of the door panel so that the perimeter of the panel's outer sheets can be readily joined to each other.

In some examples, the horizontal baffles extend as wide as possible to minimize fluid communication between the smaller chambers.

In some examples, the air pressure within the lower chamber temporarily increases as the door opens.

In some examples, the internal baffles are fused rather than sewn to the outer sheets for ease of manufacturing and to minimize air leakage between the interior and exterior of the door panel.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A door for a doorway, the door comprising:

a flexible door panel movable between an open position and a closed position relative to the doorway, the flexible door panel including a first sheet, a second sheet that is generally parallel to the first sheet when the door is in the closed position, and a plurality of pliable baffles coupled to and extending between the first sheet and the second sheet to define a plurality of air chambers within the flexible door panel, the baffles to restrict redistribution of air between a top portion and a bottom portion of the door panel when the door panel moves between the closed and open positions, without evacuating air from the door panel;

separate bodies of insulation to be disposed within two or more of the plurality of air chambers; and a mandrel about which the door panel bends as the door opens and closes, wherein the baffles are substantially parallel to the mandrel.

2. The door of claim 1, wherein the plurality of baffles at least partially maintain generally parallel spacing between the first sheet and the second sheet when the flexible door panel is in the closed position.

3. The door of claim 1, wherein at least some adjacent ones of the plurality of air chambers are in fluid communication with each other.

4. The door of claim 1, wherein the flexible door panel has an overall width that extends across the doorway, and the plurality of baffles are horizontally elongate to extend widthwise to minimize fluid communication between the plurality of air chambers.

5. The door of claim 4, wherein the plurality of baffles are shorter than the overall width of the flexible door panel.

6. The door of claim 1, wherein the plurality of air chambers includes at least one air chamber containing air at a pressure that increases as the door opens.

7. The door of claim 1, wherein the mandrel is a roller.

8. The door of claim 1, further comprising a plurality of fused joints that couple the plurality of baffles to the first sheet and the second sheet.

9. The door of claim 1, wherein the flexible door panel includes a lower leading edge that translates vertically as the door opens and closes.

10. The door of claim 1, wherein the plurality of baffles are pliable to enable limited translation of the first sheet relative to the second sheet as the door opens and closes.

11. The door of claim 1, wherein the plurality of baffles have a thermal conductivity that is generally equal to or less than that of the first sheet.

12. A method of producing a door panel that can move between an open position and a closed position relative to a doorway, the method comprising:

coupling a plurality of pliable baffles to a first sheet and a second sheet so the baffles extend between the sheets, thereby dividing the panel into a plurality of air chambers to restrict air flow between the chambers when the door panel is moved from the closed position to the open position without introducing or evacuating air to or from the panel; and non-separably connecting an outer perimeter of the first sheet to an outer perimeter of the second sheet to create an overall chamber therebetween.

13. The method of claim 12, further comprising installing insulation within two or more of the plurality of air chambers.

14. The method of claim 12, wherein the plurality of baffles maintain generally parallel spacing between the first sheet and the second sheet when the door panel is in the closed position.

15. The method of claim 12, further comprising fusing the plurality of baffles to at least one of the first sheet or the second sheet.

16. The method of claim 12, wherein the baffles are structured to bend as the door panel moves from the closed position to the open position; and the first sheet is to translate relative to the second sheet as the door panel moves from the closed position to the open position.

17. The method of claim 12, wherein at least two air chambers of the plurality of air chambers are structured to restrict distribution of air therebetween as the door panel moves from the closed position to the open position.

18. The method of claim 12, wherein the plurality of baffles are horizontally elongate.

19. The method of claim 12, wherein the door panel is structured to bend over a mandrel as the door panel moves from the closed position to the open position.

20. The door of claim 1, wherein, as the door moves from one of the open or closed positions to the other of the open or closed positions, at least one of the baffles adjacent the mandrel is at a non-perpendicular orientation relative to the sheets as at least one of the sheets translates relative to the other sheet.

21. The door of claim 20, wherein at least one of the baffles is disposed perpendicularly relative to the first and second sheets when the door is in at least one of the closed or open positions.

22. The door of claim 1, wherein the first sheet is sealed to the second sheet to define an overall chamber and the baffles substantially restrict air flow into and out of the air chambers.

23. The door of claim 1, wherein the the baffles are to be substantially parallel to the mandrel.

24. The method of claim 12, wherein the plurality of air chambers contain air at a pressure that can vary, such that, when the door panel is moved from the closed position to the open position, the pressure of the air within at least one air chamber of the plurality of air chambers will be increased.

25. A door, comprising:

a mandrel; and a door panel comprising a first sheet, a second sheet, and baffles extending between the first sheet and the second sheet to define a plurality of chambers, an outer perimeter of the first sheet non-separably coupled to an outer perimeter of the second sheet, the baffles to control air flow within the door panel when the door panel moves about the mandrel between the closed and open positions without use of an evacuation blower, wherein the baffles are substantially parallel to the mandrel to restrict air flow between a top portion and a bottom portion of the door panel when the door panel moves about the mandrel between the closed and open positions.

26. The door of claim 25, wherein non-separably coupled comprises sewing, or fusing the outer perimeter of the first sheet to the outer perimeter of the second sheet.

27. A door, comprising:

a mandrel; and a door panel comprising a first sheet, a second sheet, and baffles extending between the first sheet and the second sheet to define a plurality of chambers, an outer perimeter of the first sheet coupled to an outer perimeter of the second sheet, wherein the door panel substantially prevents air from evacuating therefrom when the door panel moves about the mandrel between the closed and open positions, the baffles to restrict air flow between a top portion and a bottom portion of the door panel when the door panel moves about the mandrel between the closed and open positions.

* * * * *